US008998448B2

(12) United States Patent
Chang

(10) Patent No.: US 8,998,448 B2
(45) Date of Patent: Apr. 7, 2015

(54) LED TUBE LAMP

(75) Inventor: Shao-Han Chang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1021 days.

(21) Appl. No.: 13/091,135

(22) Filed: Apr. 21, 2011

(65) Prior Publication Data

US 2012/0106144 A1 May 3, 2012

(30) Foreign Application Priority Data

Oct. 28, 2010 (CN) ..... 2010 1 0523197

(51) Int. Cl.

| | |
|---|---|
| ***F21V 5/04*** | (2006.01) |
| ***F21K 99/00*** | (2010.01) |
| ***F21V 5/00*** | (2006.01) |
| *F21V 7/00* | (2006.01) |
| *F21V 17/10* | (2006.01) |
| *F21Y 101/02* | (2006.01) |
| *F21Y 103/00* | (2006.01) |

(52) U.S. Cl.

CPC ... *F21K 9/17* (2013.01); *F21V 5/00* (2013.01); *F21V 7/0091* (2013.01); *F21V 17/104* (2013.01); *F21Y 2101/02* (2013.01); *F21Y 2103/003* (2013.01)

(58) Field of Classification Search

USPC ..... 362/218, 227, 244, 245, 246, 249.02

See application file for complete search history.

(56) References Cited

U.S. PATENT DOCUMENTS

| | | | | |
|---|---|---|---|---|
| 7,159,997 | B2 * | 1/2007 | Reo et al. | 362/240 |
| 7,611,260 | B1 * | 11/2009 | Lin et al. | 362/224 |
| 7,618,157 | B1 * | 11/2009 | Galvez et al. | 362/294 |
| 7,654,703 | B2 * | 2/2010 | Kan et al. | 362/362 |
| 7,658,509 | B2 * | 2/2010 | Summers et al. | 362/249.11 |
| 8,309,969 | B2 * | 11/2012 | Suehiro et al. | 257/79 |
| 8,382,314 | B2 * | 2/2013 | Ou et al. | 362/217.02 |
| 8,556,454 | B2 * | 10/2013 | Pei et al. | 362/221 |
| 2009/0219713 | A1 * | 9/2009 | Siemiet et al. | 362/218 |
| 2009/0290334 | A1 * | 11/2009 | Ivey et al. | 362/219 |
| 2010/0110679 | A1 * | 5/2010 | Teng et al. | 362/235 |
| 2010/0201911 | A1 | 8/2010 | Iiyama et al. | |
| 2012/0025235 | A1 * | 2/2012 | Van De Ven et al. | 257/98 |

FOREIGN PATENT DOCUMENTS

| | | | |
|---|---|---|---|
| CN | 1811548 | A | 8/2006 |
| CN | 101788111 | A | 7/2010 |
| TW | M331075 | | 4/2008 |
| TW | I315430 | | 10/2009 |
| TW | M389811 | U1 | 10/2010 |
| WO | 2010/092632 | A1 | 8/2010 |

* cited by examiner

*Primary Examiner* — Mary McManmon

(74) *Attorney, Agent, or Firm* — Novak Druce Connolly Bove + Quigg LLP

(57) ABSTRACT

A LED tube lamp includes a heat sink, a LED substrate, a pair of connectors, and a cover fixed to the heat sink. The cover includes a first cover and a second cover, at least one optical lens is arranged on the first cover, the at least one optical lens comprises a concave lens and reflective lenses arranged on both sides of the concave lens. The concave lens is configured to refract light beams from the LEDs in a forward direction or in an approximate forward direction, the reflective lenses are configured to reflect light beams from the LEDs in a lateral direction. After the light beams are refracted by the optical lens, the light divergence angle of the LED tube lamp is increased.

20 Claims, 6 Drawing Sheets

LED TUBE LAMP

BACKGROUND

1. Technical Field

The present disclosure relates to light emitting diode (LED) illuminating devices and, particularly, to an LED tube lamp.

2. Description of Related Art

Compared to traditional light sources, light emitting diodes (LEDs) have advantages, such as high luminous efficiency, low power consumption, and long service life. LED lights are widely used in many applications to replace typical fluorescent lamps and neon tube lamps.

Typical LED tube lamps usually include a cylindrical tube and an LED substrate. However, in order to increase the luminance, a type of LED array including a plurality of LEDs connected in series arranged on the LED substrate is used in LED tube lamps. But all the LEDs in the LED array emit light in the same direction. This kind of LED array will not increase light divergence angle of LED tube lamps.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Embodiments of the present disclosure are now described in detail, with reference to the accompanying drawings.

Figure 1:
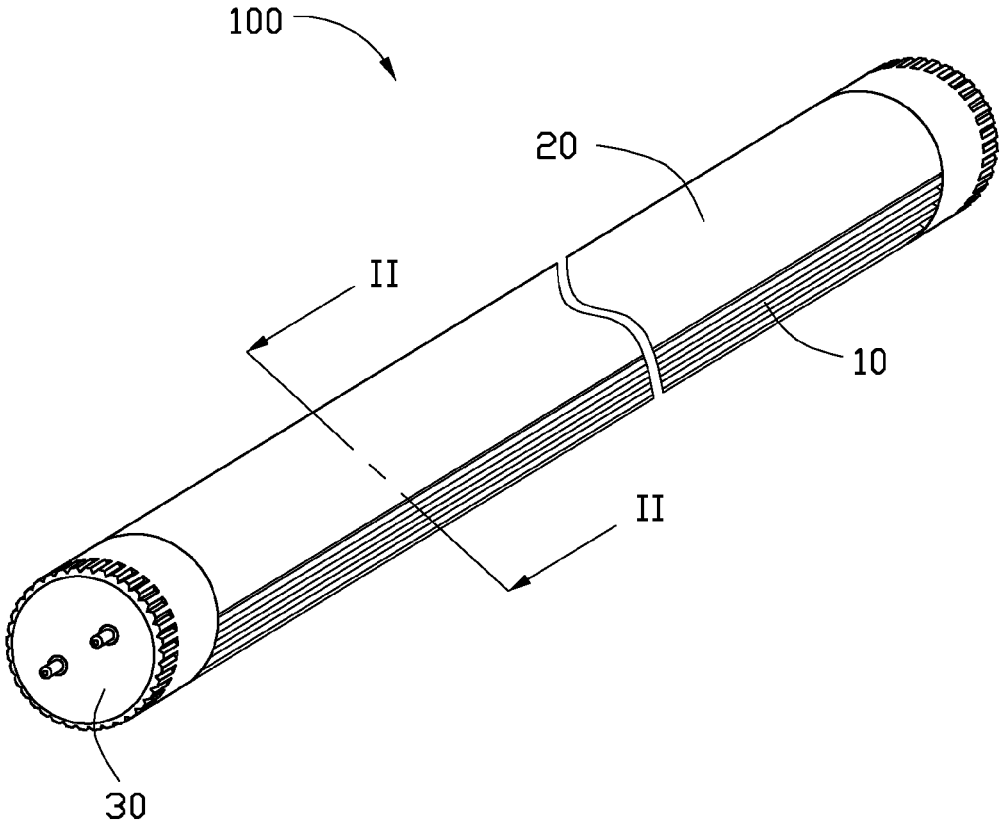
FIG. 1 is an assembled, isometric view of an LED tube lamp in accordance with a first embodiment.

Referring to FIG. 1, an LED tube lamp 100 according to a first embodiment is illustrated. The LED tube lamp 100 includes a heat sink 10, a cover 20, and a pair of connectors 30. The connectors 30 are arranged at opposite ends of the LED tube lamp 100 and are used to connect to a coupling connector (not shown), thus electrically connecting the LED tube lamp 100 to a power source.

Figure 2:
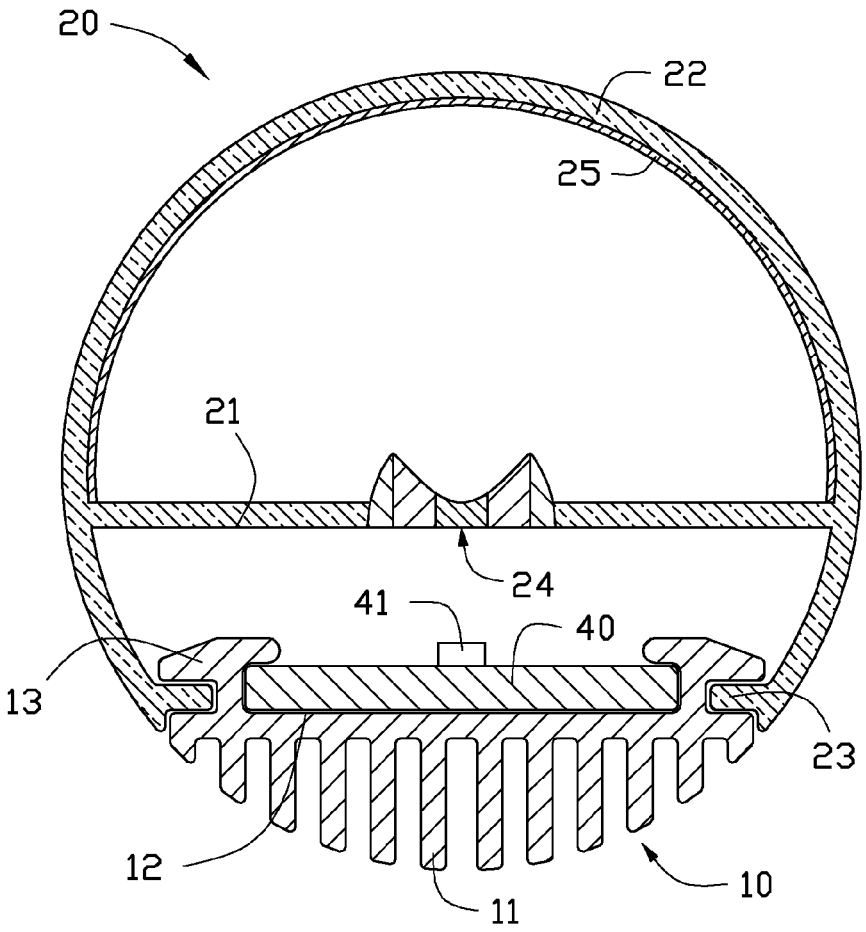
FIG. 2 is a cross-sectional view of the LED tube lamp of FIG. 1, taken along line II-II.

Referring to FIG. 2, the LED tube lamp 100 further includes an LED substrate 40 that is mounted on the heat sink 10, and electrically connected to the connector 30. A number of LEDs 41 are arranged on the LED substrate 40. The LEDs 41 can be chosen for having a large light divergence angle, high luminance, and/or colored according to actual requirements.

The heat sink 10 has an elongated structure and is made of metal with good heat conductivity, such as copper or aluminum. In another embodiment, the heat sink 10 can be made of ceramic. The heat sink 10 includes a number of cooling fins 11 arranged on the bottom surface of the heat sink 10 to increase the heat dissipation area. A recess 12 is defined in the top surface of the heat sink 10 for receiving the LED substrate 40. In this embodiment, a heat-conductive medium (not shown) can be arranged between the LED substrate 40 and the inner surface of the recess 12, for transferring the heat generated by the LEDs 41 from the LED substrate 40 to the cooling fins 11. In this embodiment, the heat-conductive medium can be thermal conductive glue or heat-conductive plate. In this embodiment, the LED substrate 40 is fixed on the heat sink 10 with screws (not shown).

The heat sink 10 further includes connecting portions 13. In the embodiment, the connecting portions 13 are grooves. The cover 20 includes two projecting members 23 extending inwardly from the opposite ends of the cover 20. The projecting members 23 are respectively received in the connecting portions 13, thus fixing the cover 20 to the heat sink 10. The cover 20 has an elongated structure and is arc-shaped in cross section.

The cover 20 includes a first cover 21 and a second cover 22, the first cover 21 is closer to the LED substrate 40 than the second cover 22. The second cover 22 has an arc-shaped cross section, with two ends fixed to opposite ends of the first cover 21. The cover 20 faces the LED substrate 40, and the light beams emitted from the LEDs 41 pass through the first cover 21, then pass through the second cover 22 to spread out.

Figure 3:
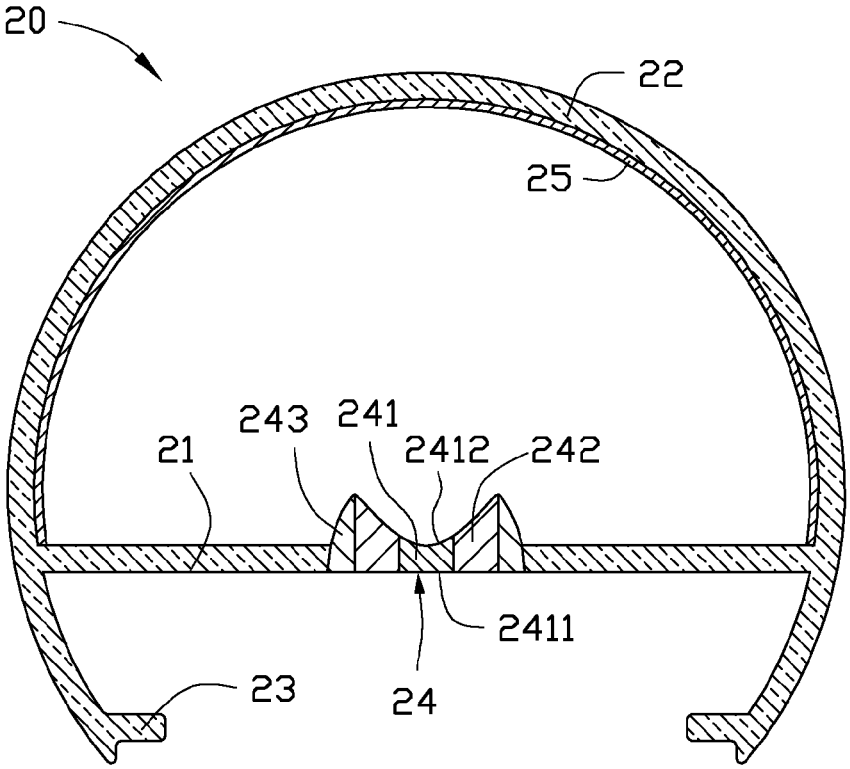
FIG. 3 is a schematic, cross-sectional view showing a cover of the LED tube lamp of FIG. 1.

Referring to FIG. 3, the first cover 21 is transparent and may be made of plastic or glass, such as polymethyl methacrylate (PMMA). The first cover 21 includes an optical lens 24 defined on the surface of the first cover 21. In the first embodiment, a row of the LEDs 41 are arranged in the middle of the LED substrate 40, the lens 24 is arranged above the LEDs 41 directly and has an elongated structure. The lens 24 includes a concave lens 241 and two reflective lenses 242 arranged on both sides of the concave lens 241. In other embodiments, two or more rows of the LEDs 41 can be arranged on the LED substrate 40, and optical lenses 24 can be designed on the surface of the first cover 21 corresponding to the two or more rows of the LEDs 41.

In the first embodiment, the concave lens 241 is a plano concave lens including a planar face 2411 and a concave face 2422. The light beams from the LEDs 41 enter the concave lens 241 from its planar face 2411 and exit from its concave face 2422. The reflective lenses 242 are total reflection prisms arranged on both sides of the concave lens 241. The top inner surface of the reflective lenses 242 is the total reflection face. The light beams from the LEDs 41 enter the reflective lenses 242 from a bottom surface and are reflected by the top inner surface. In another embodiment, the reflective lenses 242 can be a lens with a total reflection face, such as a lens with a high reflective film coated on its top surface. The lens 24 further includes scatter layers 243 arranged on lateral surface of the reflective lenses 242. The scatter layers 243 can be a film of scatter material coated on the surface of the reflective lenses 242.

Figure 4:
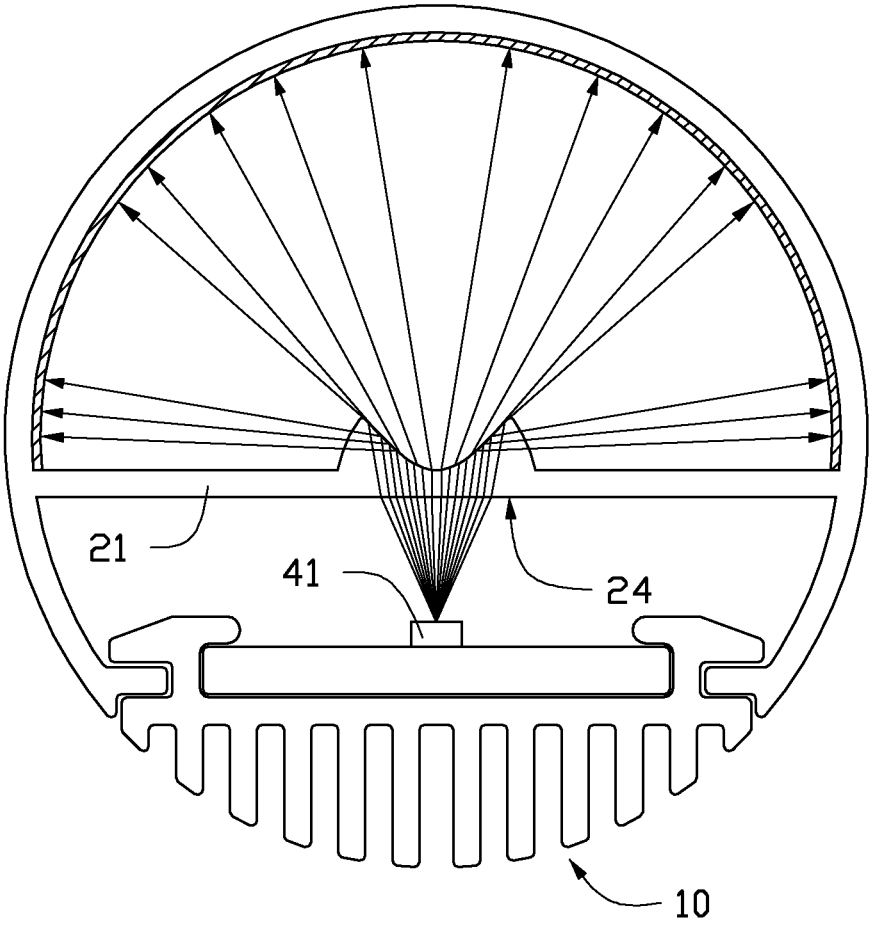
FIG. 4 is a schematic, cross-sectional view showing light beams passing through the cover of the LED tube lamp of FIG. 1.

Referring to FIG. 4, the light beams emitting from the LEDs 41 in a forward direction or in an approximate forward direction enter the concave lens 241 and are refracted by the concave lens 241, which enlarges the divergence angle. The light beams emitting from the LEDs 41 in a lateral direction enter the reflective lenses 242 and are reflected by the reflective lenses 242, which changes the direction of the light beams. The light beams reflected by the reflective lenses 242 enter the scatter layers 243 and are diffused by the scatter layers 243. After the light beams are refracted by the concave lens 241 and reflected by the reflective lenses 242, the incident angle of the light beams travelling to the second cover 22 is greatly increased. As a result, the light divergence angle of the LED tube lamp 100 is increased correspondingly. In this way, the light emitting angle of the light emitting diodes 42 enlarges, particularly, the lateral lighting direction of the LED tube lamp 100 is improved thus the light beams become softer.

The second cover 22 can be made of transparent or translucent material mixed with light diffusion particles to improve the light scattering effect of the light. In this embodiment, a scatter layer 25 is arranged on the inner surface of the second cover 22 to scatter the light incident beams from the lens 24, thus achieving a homogeneous illumination effect. The scatter layer 25 can be a coating of scatter material coated on the inner/outer surface of the second cover 22, or a film of scatter material arranged on the inner/outer surface of the second cover 22. In other embodiments, a plurality of accentuated portions such as protuberances and/or recesses can be defined on the inner/outer surface of the second cover 22 to scatter the light beams.

Figure 5:
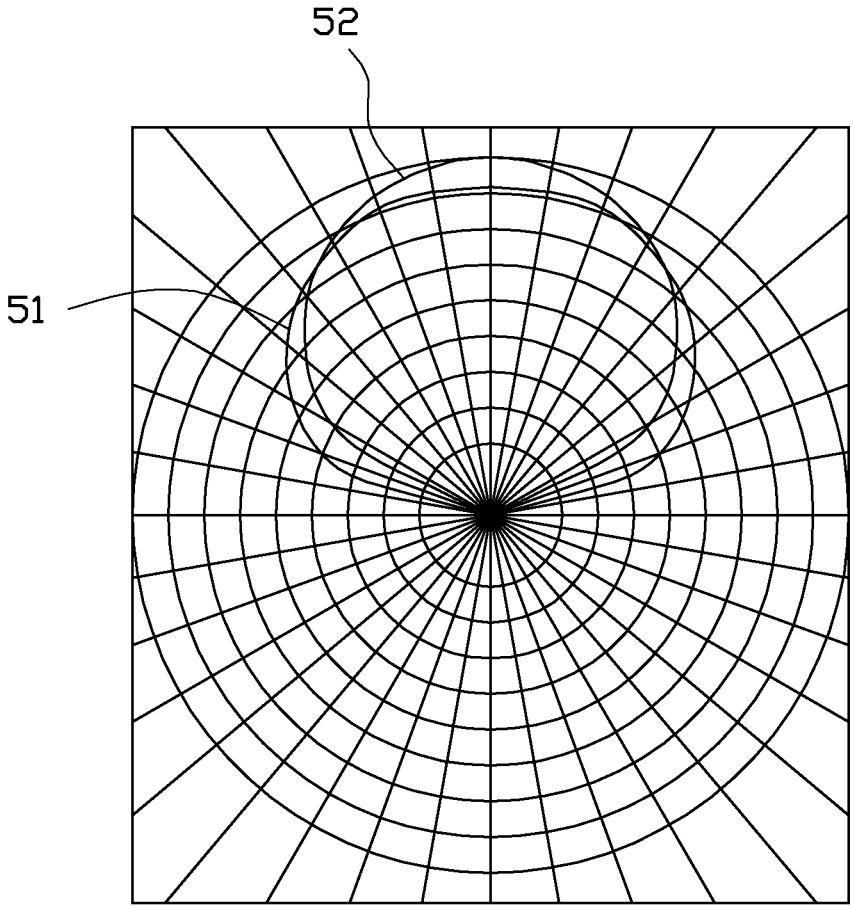
FIG. 5 is a diagram showing the radiation patterns of the LED tube lamp of FIG. 1 and a typical fluorescent tube lamp.

Referring to FIG. 5, as can be seen in the diagram, the first region 51 shows the radiation pattern of the LED tube lamp 100 in this embodiment, where the second region 52 shows the radiation pattern of a typical LED tube lamp. The light divergence angle of the LED tube lamp 100 is maximized over that of the conventional LED tube lamp.

Figure 6:
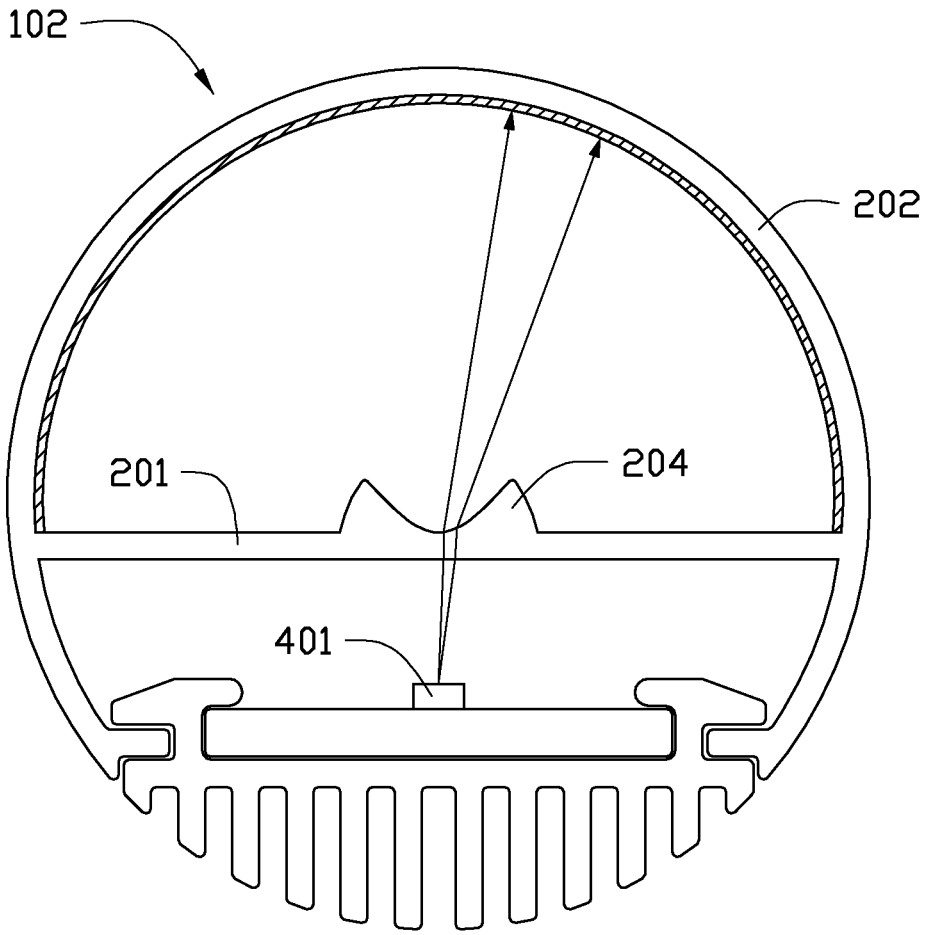
FIG. 6 is an assembled, cross-sectional view of an LED tube lamp in accordance with a second embodiment.

Referring to FIG. 6, an LED tube lamp 102 according to a second embodiment is illustrated. The LED tube lamp 102 is similar to the LED tube lamp 100 that is described above. The LED tube lamp 102 includes a cover (not labeled) and a LED substrate (not labeled) including a number of LEDs 401 arranged on the LED substrate. The cover includes a first cover 201 and a second cover 202. The difference between the lamps 102 and 100 is that the optical lens 204 defined on the surface of the first cover 201 is a concave lens. The light beams from the LEDs 401 enter the optical lens 204 and are refracted, which enlarges the divergence angle. The light beams are then refracted by the optical lens 204 and reach the second cover 202 and spread out. After the light beams are refracted by the optical lens 204, the incident angle of the light beams travelling to the second cover 202 is increased, and the light divergence angle of the LED tube lamp 100 is increased correspondingly.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED tube lamp, comprising:

a heat sink;

an LED substrate mounted on the heat sink and comprising a plurality of LEDs;

a cover fixed to the heat sink and shielding the plurality of LEDs;

wherein the cover comprises a first cover and a second cover, the first cover is closer to the LED substrate than the second cover, at least one optical lens is arranged on the first cover, each of the at least one optical lens comprises a concave lens, reflective lenses arranged on both sides of the concave lens and scatter layers arranged on lateral surface of the reflective lenses, the concave lens is a plano concave lens comprising a planar surface and a concave surface, the light beams enter the concave lens from the planar face and exit from the concave face, the concave lens are configured for refracting light beams from the LEDs in a forward direction or in an approximate forward direction, the reflective lenses are configured for reflecting light beams from the LEDs in a lateral direction.

2. The LED tube lamp according to claim 1, wherein a row of the LEDs are defined in the middle of the LED substrate, the number of the at least one optical lens is one, and the optical lens is arranged above the LEDs directly.

3. The LED tube lamp according to claim 1, wherein the reflective lenses are total reflection prism arranged on both sides of the concave lens.

4. The LED tube lamp according to claim 1, wherein the second cover is made of transparent or translucent material mixed with light diffusion particles.

5. The LED tube lamp according to claim 1, wherein the second cover further comprises a scatter layer arranged on the surface of the second cover.

6. The LED tube lamp according to claim 5, wherein the scatter layer is a coating of scatter material coated on the inner/outer surface of the second cover.

7. The LED tube lamp according to claim 5, wherein the scatter layer is a film of scatter material arranged on the inner/outer surface of the second cover.

8. The LED tube lamp according to claim 1, wherein the heat sink comprises two grooves, the cover comprises two projecting members extending inwardly from the opposite ends of the cover, the two projecting members are respectively received in the grooves.

9. The LED tube lamp according to claim 1, where a recess is defined in the top surface of the heat sink for receiving the LED substrate.

10. The LED tube lamp according to claim 1, wherein a plurality of cooling fins are arranged on the bottom surface of the heat sink.

11. An LED tube lamp, comprising:

a heat sink;

an LED substrate mounted on the heat sink and comprising a plurality of LEDs;

a cover fixed to the heat sink and shielding the plurality of LEDs;

wherein the cover comprises a first cover and a second cover, the first cover is closer to the LED substrate than the second cover, at least one optical lens is arranged on the first cover, each of the at least one optical lens comprises a concave lens, reflective lenses arranged on both sides of the concave lens and scatter layers arranged on lateral surface of the reflective lenses, a top inner surface of the reflective lenses is a total reflection face, the light beams from the LEDs enter the reflective lenses from a bottom surface and are reflected by the top inner surface, the concave lens are configured for refracting light beams from the LEDs in a forward direction or in an approximate forward direction, the reflective lenses are configured for reflecting light beams from the LEDs in a lateral direction.

12. The LED tube lamp according to claim 11, wherein a row of the LEDs are defined in the middle of the LED substrate, the number of the at least one optical lens is one, and the optical lens is arranged above the LEDs directly.

13. The LED tube lamp according to claim 11, wherein the reflective lenses are total reflection prism arranged on both sides of the concave lens.

14. The LED tube lamp according to claim 11, wherein the second cover is made of transparent or translucent material mixed with light diffusion particles.

15. The LED tube lamp according to claim 11, wherein the second cover further comprises a scatter layer arranged on the surface of the second cover.

16. The LED tube lamp according to claim 15, wherein the scatter layer is a coating of scatter material coated on the inner/outer surface of the second cover.

17. The LED tube lamp according to claim 15, wherein the scatter layer is a film of scatter material arranged on the inner/outer surface of the second cover.

18. The LED tube lamp according to claim 11, wherein the heat sink comprises two grooves, the cover comprises two projecting members extending inwardly from the opposite ends of the cover, the two projecting members are respectively received in the grooves.

19. The LED tube lamp according to claim 11, where a recess is defined in the top surface of the heat sink for receiving the LED substrate.

20. The LED tube lamp according to claim 11, wherein a plurality of cooling fins are arranged on the bottom surface of the heat sink.

* * * * *